United States Patent [19]

Rodriguez

[11] 4,226,037

[45] Oct. 7, 1980

[54] WALL DISPLAY DEVICE

[76] Inventor: Robert Rodriguez, 8515 Gilman, Westland, Mich. 48185

[21] Appl. No.: 137

[22] Filed: Jan. 2, 1979

[51] Int. Cl.[3] ..... G09F 1/12

[52] U.S. Cl. ..... 40/152.1; 40/155; 248/486

[58] Field of Search ..... 40/152.1, 155, 124.1; 248/460, 461, 477, 486; 312/224, 225, 226, 227

[56] References Cited

U.S. PATENT DOCUMENTS

| | | | |
|---|---|---|---|
| 253,730 | 2/1882 | Lueckel | 40/152.1 |
| 540,011 | 5/1895 | Wiederer | 40/152.1 |
| 2,086,443 | 7/1937 | Rutyna | 40/152.1 |
| 2,678,252 | 5/1954 | Swearingen | 312/227 X |
| 2,791,051 | 5/1957 | Scheyer | 40/152.1 |
| 3,292,285 | 12/1966 | Kitayama | 40/155 |
| 3,909,091 | 9/1975 | Tantillo | 312/227 X |

*Primary Examiner*—John F. Pitrelli
*Assistant Examiner*—G. Lee Skillington
*Attorney, Agent, or Firm*—Cullen, Sloman, Cantor, Grauer, Scott & Rutherford

[57] ABSTRACT

A folding wall display device for an office which nests together three separate display pieces and gives the appearance of a framed picture when not in use. An angled hinge permits a slimline appearance and permits the device to be essentially flush with the wall. The construction of the wall device presents a decorative appearance and provides for a variety of functional and illustrative display surfaces and/or a visual display device located in the center section adjacent to the wall. The display device has five surfaces available for display with up to three surfaces visible at once.

3 Claims, 6 Drawing Figures

WALL DISPLAY DEVICE

BACKGROUND OF THE INVENTION

Many offices and conference rooms serve a dual role. They act as places for meetings and exchange of information wherein data needs to be displayed for all to see and at other times they serve as waiting areas or areas where a party works alone and it is desirable to have a pleasing decor. In this atmosphere, it is desirable to have a wall display device for charts, graphs, or other visual displays which can be converted to an object which is aesthetically pleasing with a minimum of difficulty.

Previous wall display devices presented a bulky and non-decorative appearance if left on the wall. Thus, for appearance purposes, it was necessary to remove the devices after each use. The U.S. Patent to Swanson, No. 3,269,043, issued Aug. 30, 1966, prescribed a display device with a swing-open feature to reveal a second surface by means of a double hinge connecting each adjoining section. Swanson contains three sections and two double hinges allowing for a three-surface display, however, the device is not for wall mounting and does not permit a slim appearance because of the use of double hinges. Furthermore, Swanson does not show the use of more than three surfaces nor is the item suggested as having a decorative appearance when not in use. It is an object of the present invention to have a display device for mounting on a wall which has five display surfaces with up to three surfaces being visible at once.

SUMMARY OF THE INVENTION

The present invention provides a relatively thin, wall mounted display device consisting of three hinged sections having five display surfaces, three of which may be displayed at one time. When not in use, the hinged sections close together with one section closing into a center section and the third section covering both of the other sections, thus only one surface is presented when the device is in the closed or nested position. This one presented surface is preferably a decorative painting or mural. The device of the present invention has a shallow depth so that it is substantially flush with the wall, both in the open and closed condition. An angle hinge used for the first swing-out of the top section permits the slim appearance and efficient use of space. The wall or center section is secured to a wall or other flat surface by screws, hooks, magnets or any other device. A second or right section is hinged to the right edge of the base section and nests into it, and a third or left section is hinged to the opposite edge of the first section and covers the first two sections. The center section has one display surface lying behind the normally nested second section while the remaining two sections each have two display surfaces, one on each opposite face. Preferably, the top surface of the left section is decorative. The remaining surfaces may be chalkboard, corkboard, magnetic board, or any visual projection screen. The center section may be a television or other display device which is technologically feasible within the space limitations.

An angle hinge used for the swing-out of the left section containing the top decorative surface permits the slim appearance and allows the whole unit to be mounted substantially flush with the wall.

These and other features of the invention will become obvious when taken in conjunction with the following description of the drawings.

DETAILED DESCRIPTION OF THE INVENTION

Figure 2:
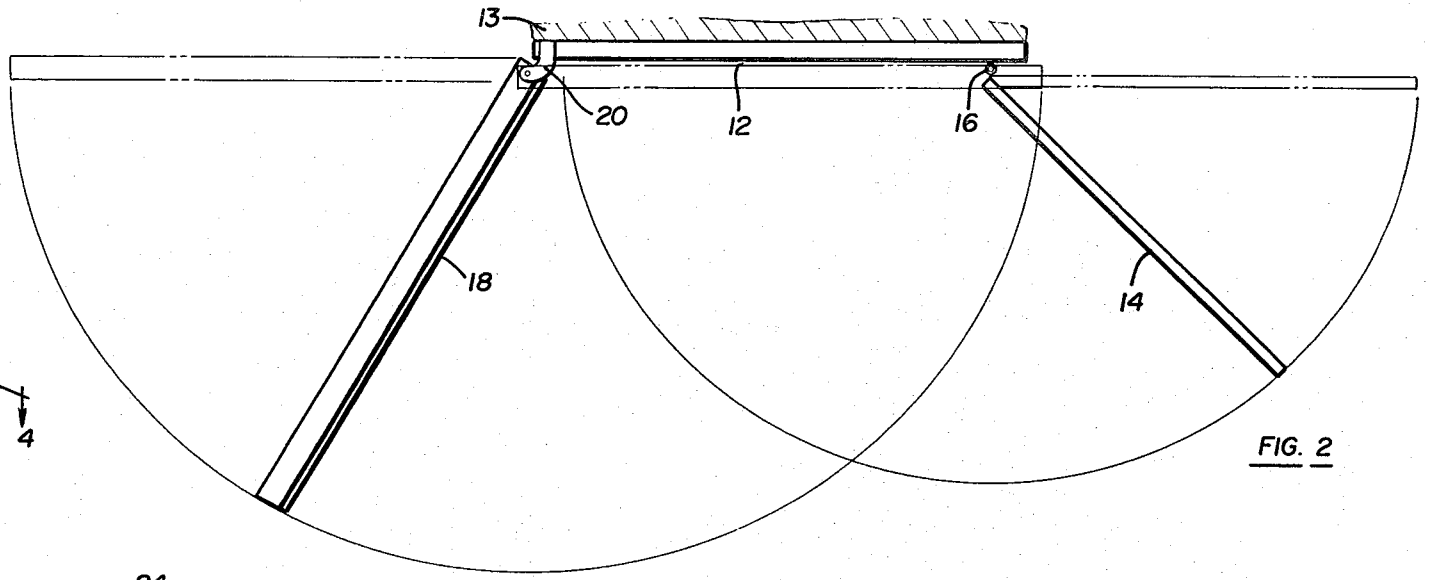
FIG. 2 is a top view of the wall display device as it is unfolding.
Figure 3:
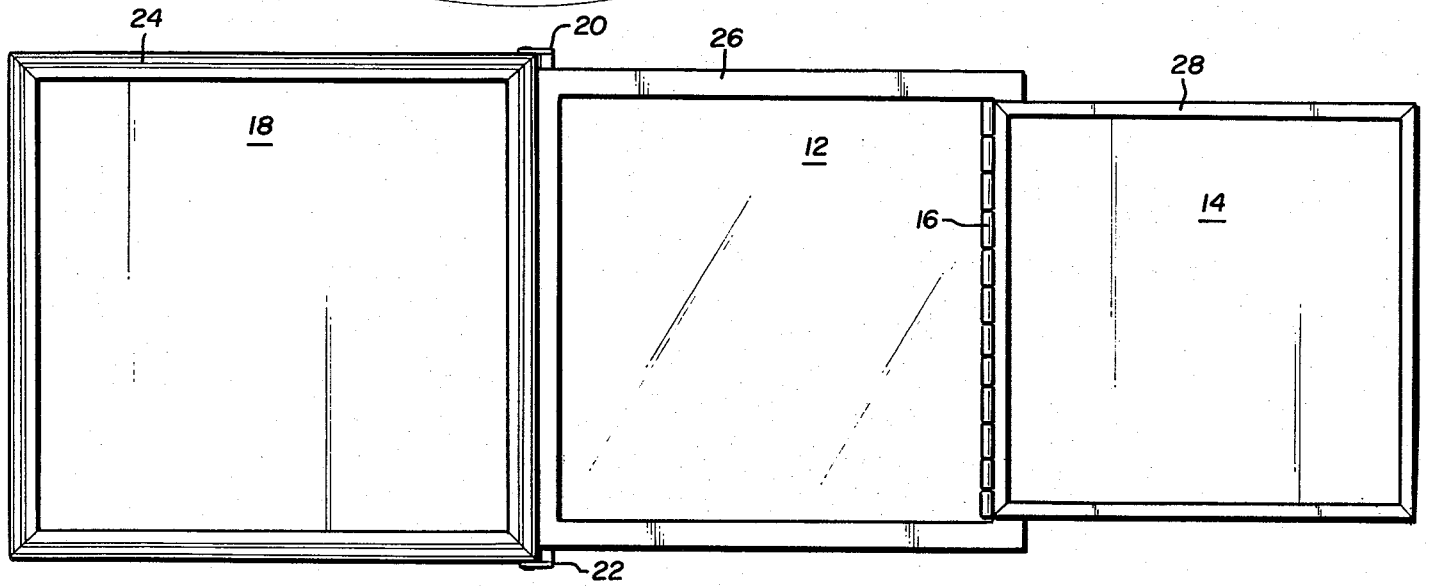
FIG. 3 is a front view of the wall display device completely folded out.
Figure 1:
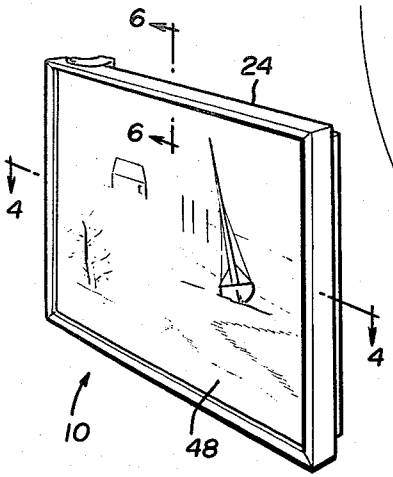
FIG. 1 is a perspective view of the display device closed and mounted on the wall.

The wall display device 10 shown in its closed position at FIG. 1 and further illustrated in its open position in FIGS. 2 and 3 comprises a center section 12 which is attached to the wall 13 as shown in FIG. 2. A right section 14 is attached to the center section 12 by means of a butt hinge 16 which permits the right section 14 to be swung outwardly to an open position as shown in FIGS. 2 and 3. A left section 18 is attached to the center section 12 near its left edge by means of two angle hinges 20 and 22 which permit the right section 14 to be swung to an open position to the left as shown in FIGS. 2 and 3. As will be discussed later, the angle hinges 20 and 22 permit the left section 18 to be swung approximately 180° from its closed position, thereby presenting a viewing surface of all three sections as shown in FIG. 3. A finished aluminum metal frame 24 surrounds the section 18 and encompasses a sufficient length and width to contain the wood frame 26 of section 12 when the display device is in its closed position as shown in FIG. 1. Likewise, the wood frame 26 of section 12 encompasses a sufficient length and width to enclose within it the metal frame 28 of section 14 when in a closed position. This enclosure by frame 24 and frame 26 is shown in conjunction with the nested arrangement of FIG. 4 which presents a cut-away view along lines 4—4 of FIG. 1.

Figure 4:
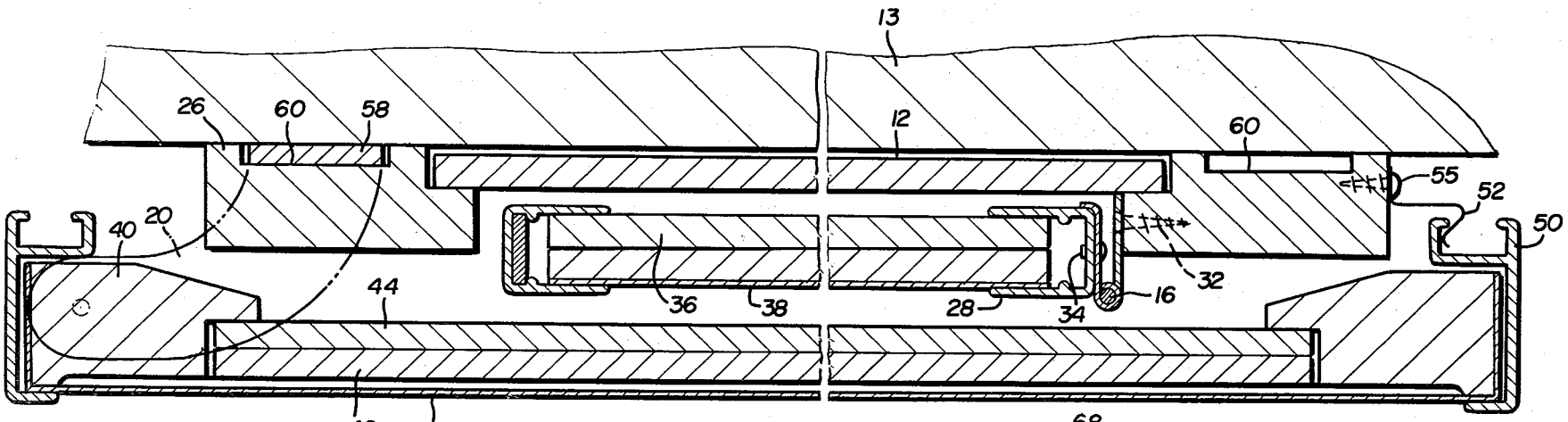
FIG. 4 is a cut away view of the wall display device taken along lines 4—4 of FIG. 1.

FIG. 4 illustrates that the center section which is mounted flush with the wall 13 comprises a display surface 30 and a frame member 26 which surrounds the display surface. The right section 14, when in the closed position of FIG. 4, nests in such a manner as to have a portion of the depth of the right section inside the generally flat, rectangular recess created by the frame 26 and the display surface 30 of the center section 12. The right section 14 is shown connected to the right side of the frame member 26 by means of a butt hinge 16 and wood screws 32. The butt hinge 16 is, in turn, connected to the metal frame 28 of section 14 by a pop rivet 34. The metal frame 28 encompasses two display surfaces 36 and 38 of the right section 14.

Figure 5:
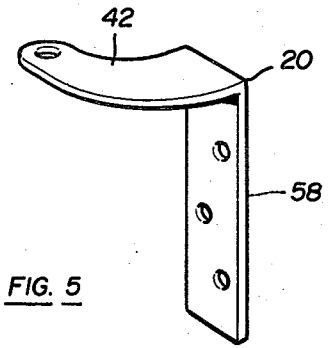
FIG. 5 is a perspective view of the angle hinge used in the wall display device.

The left section 18, which is attached to the center section 12 by means of angle hinges 20 and 22 at the left side of frame member 26, comprises the outer finished aluminum frame 24 and inner wood frame 40 which are supported by the horizontal arcuate leg 42 of the angle hinge 20 shown in FIG. 5 as well as the counterpart horizontal arcuate leg of angle hinge 22. FIG. 4 illustrates (in dotted lines) the horizontal leg for angle hinge 22 which is located at the bottom of the display device. The wood frame 40 of the section 18 encompasses display surface 44 and hardboard backing 46. Stretched across the front of the hardboard backing 46 is the decorative display surface 48 which preferably is a painting or mural.

Extending rearward from the aluminum frame member 24 is a channel shaped portion 50 which extends the entire circumference of the picture. The purpose of portion 50 is both decorative and functional in that it provides a catch for resilient retention member 52 which is attached to the center section wood frame 26 by means of wood screw 55. This permits the display device 10 to be held in its nested position when not in use and serving only as a decorative wall piece.

As can be seen from FIG. 4, a portion of the depth of the right section 14 is enclosed within the recessed area of the center section 12, with the remaining depth being enclosed or nested within the recessed area of the left section 18. The combination of the two recessed areas of the center section 12 and the left section 18 along with the shapes of the angle hinges 20 and 22 permit the enclosed nested device to be of a relatively shallow depth permitting a slim line appearance.

When, as previously discussed in conjunction with FIGS. 2 and 3, the device is opened by swinging out the left section 18, the display surfaces 44 and 38 are available for use and viewing. The angle hinges 20 and 22 locate the hinge axis for section 18, so that surface 48 of the fully opened section 18 will be substantially parallel with and closely spaced from wall 13, for neatness of appearance. When the right section 14 is swung out the right by means of the butt hinge 16, the surfaces 44, 36 and 30 are visible. With both sections swung out, as shown in FIG. 3, the maximum of three surfaces are visible.

Figure 6:
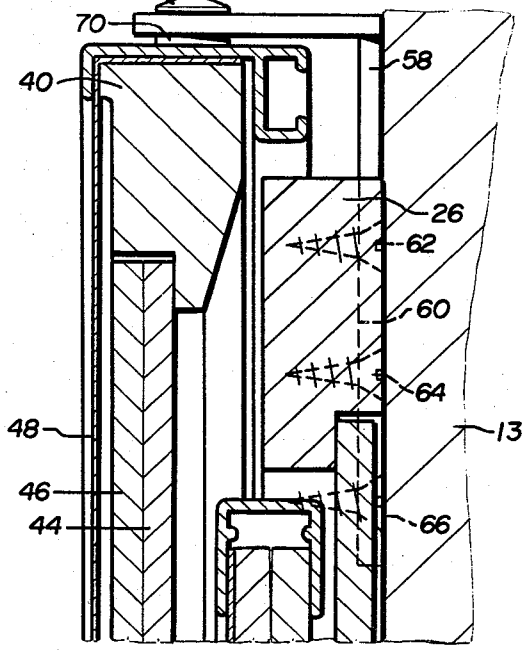
FIG. 6 is a cut away section taken along lines 6—6 of FIG. 1.

FIG. 6, taken as the section view along lines 6—6 of FIG. 1, presents a detailed showing of the placement and operation of the angle hinge 20 in conjunction with the center section 12 and the left section 18. The angle hinge 22 operates in the same manner. The vertical leg 58 of the angle hinge 20 fits into a shallow recess 60 of center section wood frame member 26, best shown in FIG. 4. The purpose of this recess is to permit the flush mounting of the device on the wall. The vertical leg member is held in position by three wood screws 62, 64 and 66. The horizontal arcuate leg 42 of the angle hinge is attached to the section 18 by means of a pop rivet 68 with pivoting being permitted by nylon bushing 70.

From the constructional details illustrated at FIG. 4, it can be easily seen that the wall display device can be easily modified to open in the opposite direction. That is, many of the structural details such as the recess 60 in the wood frame member 26 and the channel shaped extension 50 are symmetrical for aesthetic purposes as well as to allow the sections 18 and 14 to be reversed. That is, the hinges may be mounted on opposite edges to reverse the directon of opening. Alternatively, the entire device can be simply turned upside down, with appropriate changes in any decorations, ledges, hangers, etc., which may be applied thereto.

Having thus described the wall display device and its operation in detail, what is claimed is:

1. A display device adapted to be mounted on a wall comprising:

a first section of generally flat, rectangular shape and adapted to be mounted substantially flush against the wall, said first section having a generally flat rectangular recess covering substantially all of the front face thereof, said recess being faced with a first display surface;

a second section of generally flat rectangular shape and dimensioned along its height and width to freely nest into said recess of said first section, said second section being mounted to said first section by a first hinge means near a first vertical edge of said first section, said hinge means permitting said second section to be pivotally swung outward about 180° from its nested position to an open position substantially parallel to the plane of said first section, said second section having second and third display surfaces on opposite faces thereof, said second display surface facing outwardly away from the wall when said second section is in its nested position and said third display surface facing outwardly away from the wall when said second section is swung to its open position;

a third section of generally flat rectangular shape having on one face a generally flat, rectangular recess which is faced with a fourth display surface and having on its opposite face a fifth display surface, said third section being mounted to said first section by second hinge means near the second vertical edge of said first section, said third section and said recess therein being dimensioned to completely cover and obscure said first and said second sections when said third section is in a closed position, with said recess receiving at least a portion of the depth of said first and second sections, and said second hinge means permitting said third section to be swung outward about 180° from said closed position to an open position substantially parallel to the plane of said first section.

2. The display device of claim 1 wherein said second hinge means comprises two angle hinges each having an arcuate horizontal leg and a vertical leg.

3. The display device of claim 2, said third section is hinged to said first section in such a manner as to present a relatively thin display device and wherein said third section is substantially flush with the wall when in the open position.

* * * * *